US011678728B2

(12) United States Patent
Peng et al.

(10) Patent No.: US 11,678,728 B2
(45) Date of Patent: Jun. 20, 2023

(54) ZIPPER AND GARMENT HAVING THE SAME

(71) Applicant: ZHEJIANG WEIXING INDUSTRIAL DEVELOPMENT CO., LTD., Zhejiang (CN)

(72) Inventors: Guifei Peng, Zhejiang (CN); Yishu Huang, Zhejiang (CN)

(73) Assignee: ZHEJIANG WEIXING INDUSTRIAL DEVELOPMENT CO., LTD., Zhejiang (CN)

( * ) Notice: Subject to any disclaimer, the term of this patent is extended or adjusted under 35 U.S.C. 154(b) by 0 days.

(21) Appl. No.: 17/568,756

(22) Filed: Jan. 5, 2022

(65) Prior Publication Data

US 2022/0125165 A1 Apr. 28, 2022

Related U.S. Application Data

(63) Continuation-in-part of application No. 16/335,682, filed as application No. PCT/CN2017/080996 on Apr. 19, 2017, now abandoned.

(30) Foreign Application Priority Data

Nov. 23, 2016 (CN) ..... 201621269524.1

(51) Int. Cl.
*A44B 19/30* (2006.01)
*A44B 19/26* (2006.01)

(52) U.S. Cl.
CPC ..... *A44B 19/306* (2013.01); *A44B 19/262* (2013.01)

(58) Field of Classification Search
CPC .... A44B 19/306; A44B 19/262; A44B 19/308
See application file for complete search history.

(56) References Cited

U.S. PATENT DOCUMENTS 1,969,672 A * 8/1934 Poux ..... A44B 19/305 24/419
2,162,266 A * 6/1939 Marinsky ..... A44B 19/305 24/419

(Continued)

FOREIGN PATENT DOCUMENTS

CN 101406338 A 4/2009
CN 203828208 U 9/2014

(Continued)

OTHER PUBLICATIONS

International Search Report for PCT/CN2017/080996 dated Aug. 21, 2017, ISA/CN.

*Primary Examiner* — David M Upchurch
(74) *Attorney, Agent, or Firm* — Yue (Robert) Xu; Apex Attorneys at Law, LLP

(57) ABSTRACT

A zipper includes zipper teeth, a zipper head base for engaging or disengaging zipper teeth, and a puller with an end hole. The zipper head base includes a body with a pivotal mounting portion, a hook-shaped locking plate with a locking pin, and a biasing member, the hook-shaped locking plate is pivotally connected to the pivotal mounting portion, and the locking pin of the hook-shaped locking plate is configured to pass through the end hole of the puller. The zipper head base has a locked state, in which the biasing member provides a biasing force to the locking plate, so that the locking pin is allowed to be inserted into the engaged zipper teeth to restrict bidirectional movement of the zipper head base. A garment including the zipper is further provided according to the application.

11 Claims, 6 Drawing Sheets

(56) References Cited

U.S. PATENT DOCUMENTS 2,537,749 A * 1/1951 Gloss ..... A44B 19/305 24/419
2,540,693 A * 2/1951 Irashur ..... A44B 19/305 24/419
3,018,534 A * 1/1962 Huelster ..... A44B 19/305 24/419
3,099,059 A * 7/1963 Huelster ..... A44B 19/306 24/421
3,112,546 A * 12/1963 Jensen ..... A44B 19/305 24/419
3,852,852 A * 12/1974 Watanabe ..... A44B 19/305 24/419
3,896,538 A 7/1975 Watanabe
4,137,609 A * 2/1979 Kedzierski ..... A44B 19/305 24/419
4,982,479 A * 1/1991 Oda ..... A44B 19/308 24/420
5,255,418 A * 10/1993 Chen ..... A44B 19/308 24/421
5,956,819 A * 9/1999 Terasaki ..... A44B 19/26 24/424
7,111,367 B2 * 9/2006 Keyaki ..... A44B 19/26 24/381
7,665,194 B2 * 2/2010 Iwase ..... A44B 19/305 24/419
9,125,459 B1 * 9/2015 Lin ..... A44B 19/02
9,370,225 B1 * 6/2016 Lin ..... A44B 19/26
10,561,207 B2 * 2/2020 Lin ..... A44B 19/262
2002/0189057 A1 * 12/2002 Lin ..... A44B 19/308 24/421
2005/0022346 A1 * 2/2005 Wang ..... A44B 19/262 24/429
2009/0313793 A1 * 12/2009 Lin ..... A44B 19/26 24/429
2012/0117766 A1 * 5/2012 Damon ..... A44B 19/265 24/415
2014/0123445 A1 * 5/2014 Jung ..... A44B 19/308 24/424
2016/0338455 A1 * 11/2016 Chuan ..... A44B 99/005
2017/0013920 A1 * 1/2017 Smith ..... A44B 19/306
2018/0035765 A1 * 2/2018 Lin ..... A44B 19/308
2019/0021452 A1 * 1/2019 Huang ..... E05B 35/105
2019/0059525 A1 * 2/2019 Hung ..... A44B 19/262

FOREIGN PATENT DOCUMENTS

CN 104754979 A 7/2015
CN 205547646 U 9/2016
WO 2015150724 A1 10/2015

* cited by examiner

ZIPPER AND GARMENT HAVING THE SAME

This application is continuation in part of the U.S. application Ser. No. 16/335,682 filed on Mar. 22, 2019, which is national phase of International Application No. PCT/CN2017/080996, titled "CLOTHING AND ZIPPER THEREOF", filed on Apr. 19, 2017, which claims the priority to Chinese patent application No. 201621269524.1, titled "GARMENT AND ZIPPER THEREOF", filed with the China National Intellectual Property Administration on Nov. 23, 2016, the entire disclosures thereof are incorporated herein by reference.

FIELD

The present application relates to the field of garments, and in particular to a zipper for a garment. The present application further relates to the garment having the zipper.

BACKGROUND

With the development of economy and scientific technology of human society, a zipper has developed, after a long evolution, from the initially metal material to the non-metal material, from single model and single function to multi models and comprehensive functions, from simple construction to today's delicate, beautiful and colorful construction. The performance, structure and material of the zipper are changing with each passing day, and the zipper is widely used in various fields such as aerospace, aviation, military and medical fields and civil use. A little zipper plays an increasingly important role in people's lives, and increasingly shows its importance and vitality.

CN102048312A discloses a currently and widely used zipper, which includes a slider body, an elastic member and a self-locking member. An upper wing plate of the slider body is provided with a puller stopper and a through hole, and one end of the puller stopper is connected to the upper wing plate of the slider body is connected, and a gap is formed between the other end of the puller stopper and the upper wing plate of the slider body for a puller rod of the puller to pass through. The self-locking member is pivotally connected to the slider body. The self-locking member includes a buckling portion, a spur portion and an abutting portion, where the abutting portion is provided at the front end of the self-locking member, and the buckling portion is provided at the rear end of the self-locking member, and the spur portion is provided obliquely downward from the bottom end of the abutting portion, and the elastic member is respectively connected to the slider body and the abutting portion of the self-locking member. During operation, by rotation, a gap is formed between the buckling portion of the self-locking member and the upper wing plate of the slider body for the puller rod of the puller to pass through.

CN209660597U discloses an axially rotatable semi-automatic zipper head, which includes a single head and a puller. A positioning groove seat is provided on the upper side of the single head, and a pin shaft is provided inside the positioning groove. A return spring is provided around the pin shaft, and a rotating end of the puller is covered on the outside of the return spring and is rotatably connected to the pin shaft. A lower side of the puller is provided with a locking pin, and a locking pin hole is defined on an upper side of the single head. A upper side of the return spring is in contact with the rotating end of the puller, and a lower side of the return spring is in contact with the single head, so that the puller can be pressed downward to be attached to the upper side of the single head under the elastic force of the return spring, and the locking pin is inserted into the locking pin hole to complete self-locking. The puller can be flipped upward to release the locking.

SUMMARY

A zipper which can realize two-way self-locking when the zipper is pulled to a desirable position is provided by the present application. A garment have the zipper is further provided by the present application.

The zipper includes zipper teeth, a zipper head base for engaging or disengaging zipper teeth, and a puller with an end hole. The zipper head base includes a body with a pivotal mounting portion, a hook-shaped locking plate with a locking pin, and a biasing member, and the hook-shaped locking plate is pivotally connected to the pivotal mounting portion, and the locking pin of the hook-shaped locking plate is configured to pass through the end hole of the puller. The zipper head base has a locked state, in which the biasing member provides a biasing force for the locking plate so that the locking pin is allowed to be inserted into engaged zipper teeth, thereby preventing a bidirectional movement of the zipper head base.

Preferably, the biasing member is connected between an end, away from the locking pin, of the hook-shaped locking plate and the body.

Preferably, in a case that one hook-shaped locking plate is provided, the locking pin has two pointed ends, and a distance between the two pointed ends exactly spans one tooth of the engaged teeth.

Preferably, in a case that two hook-shaped locking plates are provided, two locking pins of the two hook-shaped locking plates are bent at different angles, so that a distance between the locking pins exactly spans one tooth of the zipper teeth when the zipper head base is in the locked state.

Preferably, the puller is provided with a position-limiting portion to prevent the puller from lateral sway, and the hook-shaped locking plate is provided with a friction surface configured to be in sliding frictional contact with the position-limiting portion.

Preferably, two of the position-limiting portions are symmetrically provided at two sides of the hook-shaped locking plate.

Preferably, the position-limiting portions are integrally formed with the puller.

Preferably, a hand holding portion is provided at an end of the puller away from the through hole.

Preferably, the hook-shaped locking plate is pivotally connected to a pivotal connecting portion by a pin bolt.

Preferably, the biasing member is a spring.

A garment is further provided according to the present application, and the garment includes the zipper described in any of the above aspects.

Preferably, the garment is a sportswear.

Compared with the above background technology, in the locked state, when the puller is sagging, bidirectional self-locking of the zipper head base located at a position of any engaged zipper tooth can be achieved by the zipper provided according to the present application by inserting the locking pin into the engaged zipper teeth, and when the puller is pulled up, the above locking is automatically unlocked, and the zipper head base can be pulled up and down again.

BRIEF DESCRIPTION OF THE DRAWINGS

For more clearly illustrating embodiments of the present application or technical solutions in the conventional technology, the drawing referred to describe the embodiments or the conventional technology will be briefly described hereinafter. Apparently, the drawings in the following description are only some examples of the present application, and for those skilled in the art, other drawings may be obtained based on the provided drawing without any creative efforts.

DETAILED DESCRIPTION OF THE EMBODIMENTS

Technical solutions of embodiments of the present application will be clearly and completely described hereinafter in conjunction with the drawings of the embodiments according to the present application. Apparently, the embodiments described are only some embodiments of the present application, rather than all embodiments. Any other embodiments obtained by those skilled in the art and based on the embodiments of the present application without any creative work fall in the scope of protection of the present application.

In order to allow the person skilled in the art to better understand solutions of the present application, the present application is described further in detail hereinafter in conjunction with the drawings and embodiments.

Figure 1:
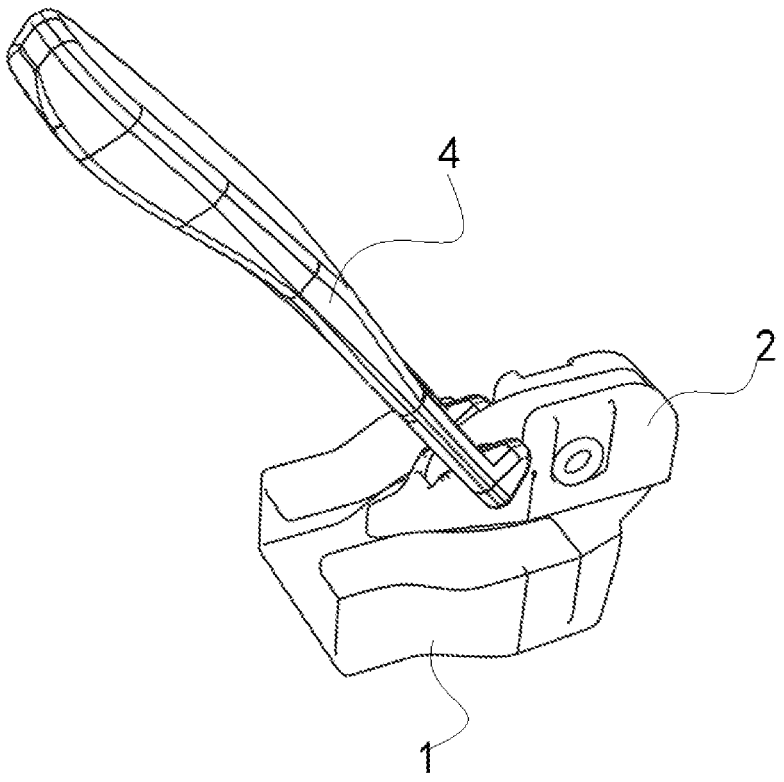
FIG. 1 is a schematic view of a zipper in use provided according to a first embodiment of the present application.
Figure 2:
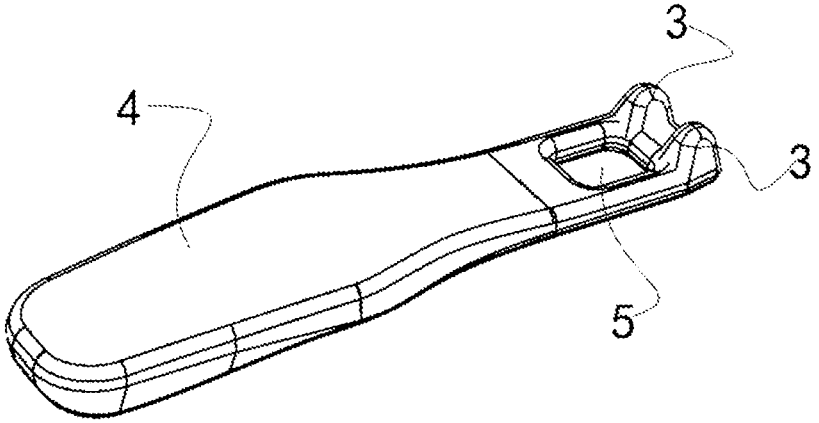
FIG. 2 is a schematic view of a puller shown in FIG. 1.
Figure 3:
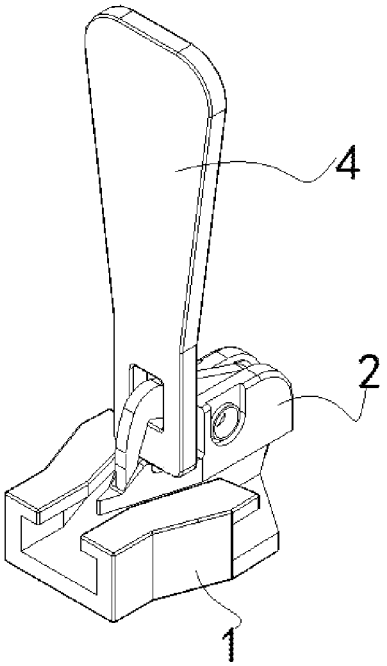
FIG. 3 is a schematic view of the zipper in FIG. 1 viewed from another angle.
Figure 4:
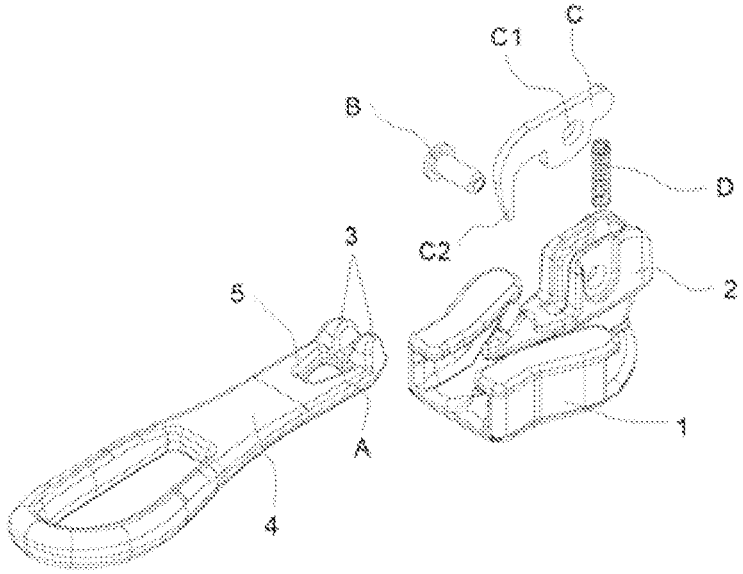
FIG. 4 is an explosive view of the zipper provided according to the first embodiment of the present application.
Figure 5:
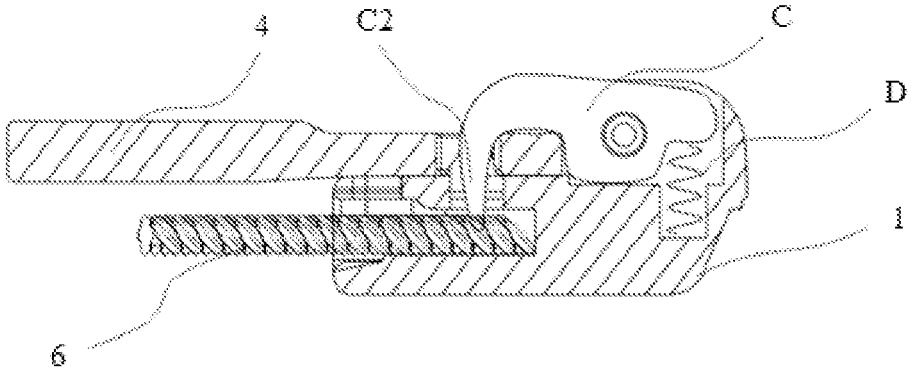
FIG. 5 is a schematic view of the zipper in a locked state provided according to the first embodiment of the present application.
Figure 6:
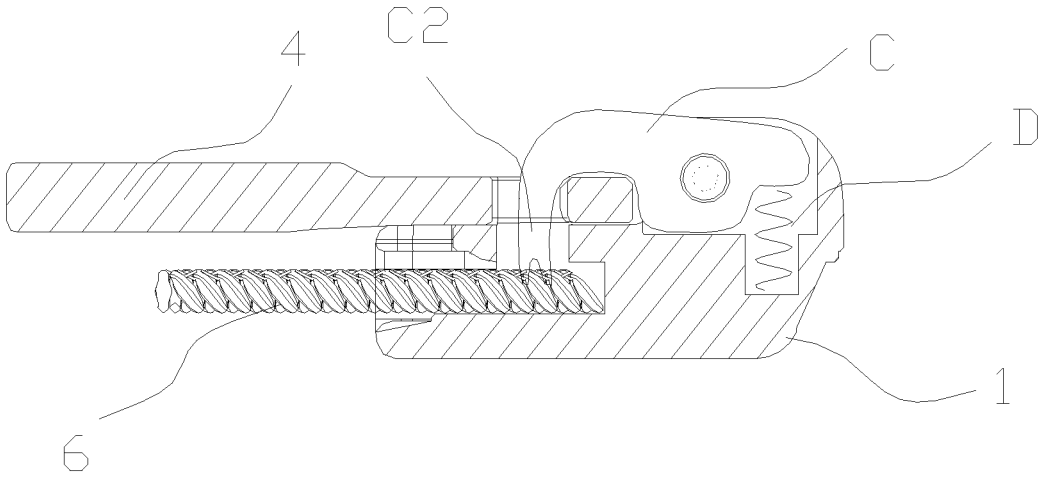
FIG. 6 is a schematic view of a zipper in an unlocked state provided according to a second embodiment of the present application.
Figure 7:
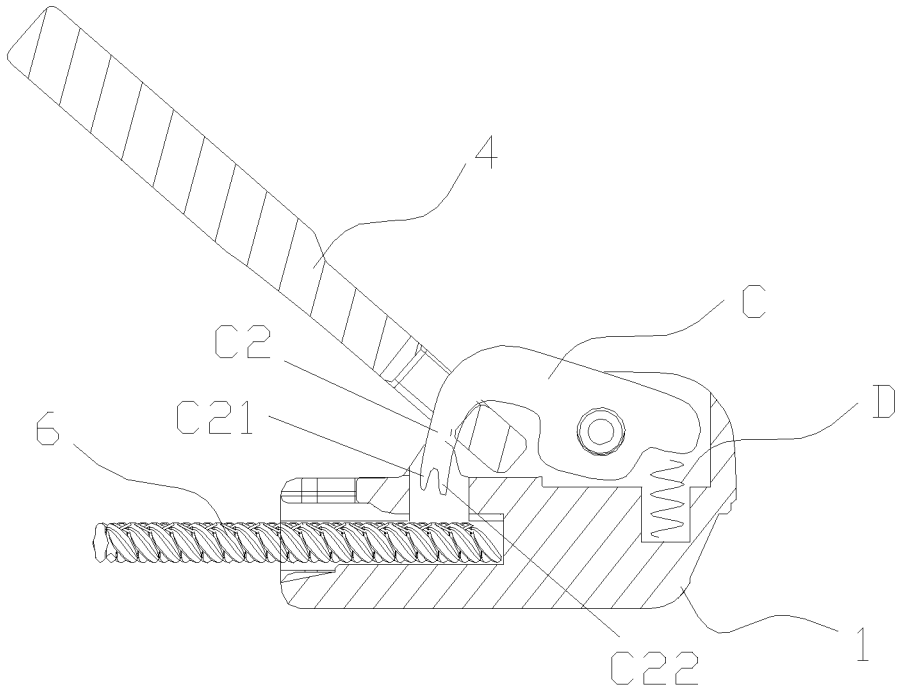
FIG. 7 is a schematic view of the zipper in a locked state provided according to the second embodiment of the present application.
Figure 8:
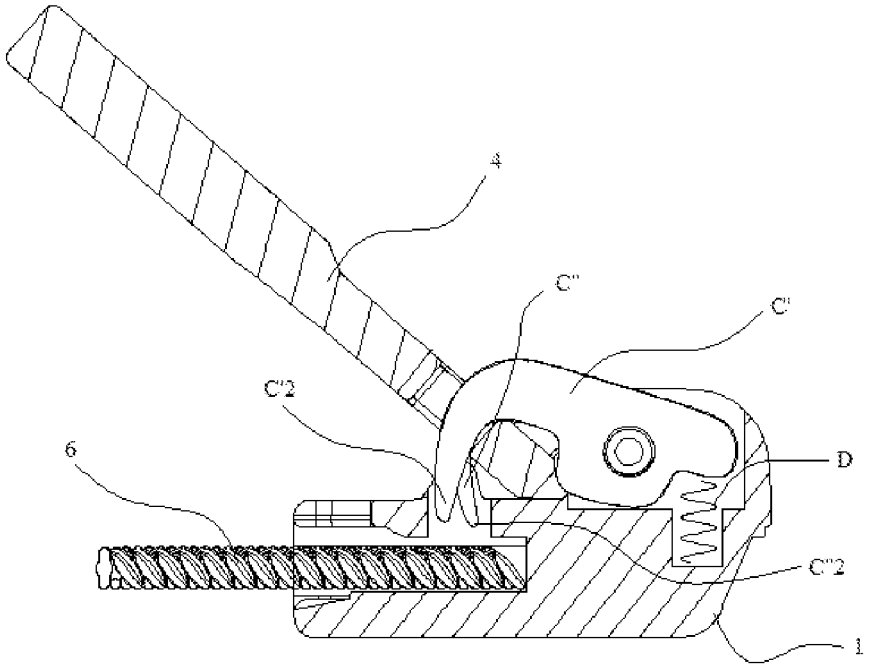
FIG. 8 is a schematic view of a zipper in an unlocked state provided according to a third embodiment of the present application.
Figure 9:
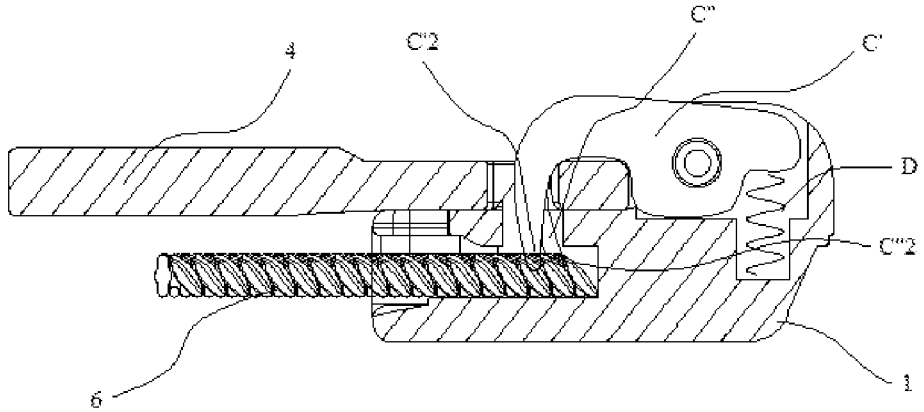
FIG. 9 is a schematic view of the zipper in a locked state provided according to the third embodiment of the present application.

Reference is made to FIGS. 1 to 6, and FIG. 1 is a schematic view of a zipper in use provided according to an embodiment of the present application; FIG. 2 is a schematic view of a puller shown in FIG. 1; FIG. 3 is a schematic view of the zipper in FIG. 1 viewed from another angle; FIG. 4 is an explosive view of the zipper provided according to the first embodiment of the present application; FIG. 5 is a schematic view of the zipper in a locked state provided according to the first embodiment of the present application; FIG. 6 is a schematic view of a zipper in an unlocked state provided according to a second embodiment of the present application; FIG. 7 is a schematic view of the zipper in a locked state provided according to the second embodiment of the present application; FIG. 8 is a schematic view of a zipper in an unlocked state provided according to a third embodiment of the present application. FIG. 9 is a schematic view of the zipper in a locked state provided according to the third embodiment of the present application.

A zipper for a garment is provided according to the present application. It is well known that, a zipper is a fastener generally including two tapes each having a row of metal or plastic teeth, and is used for connecting the edges of an opening (such as a garment or a pocket). The zipper has a slider which can pull the two rows of teeth into an interlocking position, to seal the opening. The above metal teeth or plastic teeth are zipper teeth, and a zipper head base is pulled upward or downward relative to the zipper teeth to realize the engagement or disengagement of the zipper teeth. The puller is connected to the zipper head base and is to be hold by the user by hand to be pulled upward or downward, thereby realizing the engagement and disengagement of the zipper teeth.

As shown in FIGS. 1 to 5 of the specification, the zipper head base includes a body 1, a hook-shaped locking plate C with a locking pin C2, a pin bolt B, and a spring D. The body 1 has a pivotal connecting portion 2, and the locking pin C2 of the hook-shaped locking plate C is connected to a puller 4 through an end hole of the puller 4, so that the puller 4 can rotate relative to the zipper head base. The rotation direction is defined as a first direction in the present application.

When dressing, the user normally holds the puller 4 and pulls the puller 4 upward along the length direction of the human body to achieve the engagement of the zipper teeth 6. The puller 4 includes a first end and a second end, the first end cooperates with the locking pin C2 of the zipper head base to realize rotation, and the second end is away from the end hole.

Before being pulled upward along the length direction of the body, the second end of the puller 4, under the action of gravity, tends to face downward and is located at a lower part of the zipper head base. Thus, it is required to hold the second end by hand to rotate the puller 4 relative to the zipper head base, so as to ensure that the second end is located at an upper part of the zipper head base, such that the puller 4 can be moved upward, thereby achieving the engagement of the zipper teeth 6.

In a second embodiment, the locking pin C2 may have two pointed ends C21 and C22, as shown in FIG. 6 and FIG. 7. A distance between the two pointed ends exactly spans one tooth in the engaged teeth.

In a third embodiment, two hook-shaped locking plates C' and C" may be provided. As shown in FIG. 8 and FIG. 9, the two locking pins are arranged in parallel and bent at different angles so that a distance between pointed end C'2 and pointed end C"2 of the locking pins exactly spans one tooth in the engaged teeth when the zipper head base is in the locked state.

During the rotation of the second end, since there is a certain gap between the first end and the locking pin C2 of the hook-shaped locking plate C, the puller 4 may sway left and right relative to the zipper head base during the rotation in the first direction. The swaying direction is defined as a second direction in the present application. Apparently, the second direction is perpendicular to the first direction.

A position-limiting portion is provided on the puller 4 according to the present application, and the position-limiting portion and the hook-shaped locking plate C with the locking pin C2, of the zipper head base form a hinge form, thereby preventing the puller 4 from swaying in the second direction. Therefore, the left and right sides of the puller are steady when the puller is moved upward or downward by hand, achieving a steady process of engaging or disengaging the zipper teeth 6 and ensuring the convenience of dressing.

The position-limiting portion may be embodied as a protrusion 3 shown in FIGS. 1 and 2 of the specification. The hook-shaped locking plate C with the locking pin C2, of the zipper head base is connected to the pivotal connecting portion 2 through a pin bolt B, and the hook-shaped locking plate has a locking plate hole C1, and the pin bolt B is configured to pass through the locking plate hole C1 and a hole defined on the pivotal connecting portion, as shown in FIG. 4 of the specification. The pivotal connecting portion 2 and the zipper head base can be integrally formed, and both are preferably metal parts to ensure the service life of the zipper.

As shown in FIG. 1 of the specification, the pivotal connecting portion 2 has a certain thickness in the horizontal direction as shown in FIG. 1 of the specification. The first end of the puller 4 has two protrusions 3, and inner side walls of the two protrusions 3 are in sliding frictional contact with the two sides of the hook-shaped locking plate C in the thickness direction thereof. In the process of rotating the puller 4 in the first direction, the two protrusions 3 are always in contact with two sides of the hook-shaped locking plate C in its thickness direction, thereby ensuring that the left and right sides of the puller are stable, achieving the steady process of engaging or disengaging the zipper teeth 6, and ensuring the convenience of dressing.

An end hole 5 may be defined on the first end of the puller 4, as shown in FIG. 2 of the specification. The hook-shaped locking plate C passes through the end hole 5 of the puller 4 to achieve connection, as shown in FIG. 3 of the specification.

As shown in FIG. 3 of the specification, a width of the end hole 5 is larger than or equal to the thickness of the hook-shaped locking plate C, so that the puller 4 can rotate relative to the pivotal connecting portion 2 in the first direction; and when the width of the end hole 5 is equal to the thickness of the through hole, the angle of rotation of the puller 4 relative to the pivotal connecting portion 2 in the second direction can be further reduced, and combining the action of the protrusions 3, the phenomenon of swaying can be further avoid.

Two protrusions 3 may be symmetrically arranged at two sides of the hook-shaped locking plate C, that is, the two position-limiting portions are symmetrically arranged at two sides of the end hole 5. The protrusions 3 and the puller 4 can be integrally formed.

The second end of the puller 4 may be provided with a hand holding portion, that is, a hand holding portion to be held by hand is arranged at the end away from the through hole, which achieves the purpose of conveniently pulling the puller 4 upward or downward. The hand holding portion may be embodied as a corrugated uneven portion for increasing the friction between the puller 4 and the hand, thereby improving the success rate of holding the puller 4.

As shown in FIGS. 4 to 6 of the specification, the hook-shaped locking plate C is pivotally connected to the pivotal connecting portion 2 through the pin bolt B, and the spring D is connected between an end, away from the locking C2, of the hook-shaped locking plate C and the body 1. The locking pin C2 of the hook-shaped locking plate C is configured to pass through the end hole 5 of the puller, so that the puller 4 can rotate clockwise or counterclockwise in the first direction relative to the zipper head base.

During operation, the zipper head base has a locked state. After user pulls the zipper head base to a desired position, the puller sags naturally. When the puller is in a natural sagging state, a biasing force of the spring D allows the locking pin C2 of the locking plate C to be inserted into the engaged zipper teeth, thereby realizing a locking in both upward and downward directions, as shown in FIG. 5. When the puller is in other states, as shown in FIG. 6, the locking pin C2 would leave the engaged zipper teeth under the action of the puller 4, thereby realizing an unlocking in both upward and downward directions, and the user can pull the puller to drag the zipper head base in a desired direction.

A garment having a zipper provided by the present application includes the zipper described in the above specific embodiments, and other parts of the garment can refer to the conventional technology, and are not described herein. The above garment may be a sportswear, an outdoor wear or other types of garment.

It should be noted that, relationship terms herein such as first and second are merely used to distinguish an entity from other entities and do not require or imply that there are any such actual relationships or sequences between these entities.

The garment and the zipper thereof according to the present application are described in detail hereinbefore. The principle and the embodiments of the present application are illustrated herein by specific examples. The above description of examples is only intended to help the understanding of the method and spirit of the present application. It should be noted that, for those skilled in the art, several modifications and improvements may be made to the present application without departing from the principle of the present application, and these modifications and improvements are also deemed to fall into the scope of protection of the present application defined by the claims.

The invention claimed is:

1. A zipper, comprising:

zipper teeth, a zipper head base for engaging or disengaging zipper teeth, and a puller with an end hole, wherein the zipper head base comprises:

a body with a pivotal mounting portion, a hook-shaped locking plate with a locking pin, and a biasing member, wherein the hook-shaped locking plate is pivotally connected to the pivotal mounting portion, and the locking pin of the hook-shaped locking plate is configured to pass through the end hole of the puller, the zipper head base has a locked state, in which the biasing member provides a biasing force to the locking plate, so that the locking pin is allowed to be inserted into the engaged zipper teeth to restrict bidirectional movement of the zipper head base, wherein one hook-shaped locking plate is provided, the locking pin has two pointed ends, and a distance between the two pointed ends exactly spans one tooth of the engaged teeth.

2. The zipper according to claim 1, wherein the biasing member is connected between an end, away from the locking pin, of the hook-shaped locking plate and the body.

3. The zipper according to claim 1, wherein two hook-shaped locking plates are provided, two locking pins of the two hook-shaped locking plates are bent at different angles, so that a distance between pointed ends of the locking pins exactly spans one tooth of the zipper teeth when the zipper head base is in the locked state.

4. The zipper according to claim 1, wherein the puller is provided with a position-limiting portion to prevent the puller from lateral sway, and the hook-shaped locking plate is provided with a friction surface configured to be in sliding frictional contact with the position-limiting portion.

5. The zipper according to claim 4, wherein two position-limiting portions are symmetrically provided at two sides of the hook-shaped locking plate.

6. The zipper according to claim 5, wherein the position-limiting portions are integrally formed with the puller.

7. The zipper according to claim 5, wherein a hand holding portion is provided at an end of the puller away from the through hole.

8. The zipper according to claim 1, wherein the hook-shaped locking plate is pivotally connected to a pivotal mounting portion by a pin bolt.

9. The zipper according to claim 1, wherein the biasing member is a spring.

10. A garment, comprising the zipper according to claim 1.

11. The garment according to claim 10, wherein the garment is a sportswear.

* * * * *